US006272783B1

(12) United States Patent
Dumortier et al.

(10) Patent No.: US 6,272,783 B1
(45) Date of Patent: Aug. 14, 2001

(54) FIRING MECHANISM FOR FIRE ARMS

(75) Inventors: Thierry Dumortier, Oupeye; Claude Dodrimont, Bolland, both of (BE)

(73) Assignee: Browning International, societe anonyme (BE)

( * ) Notice: Subject to any disclaimer, the term of this patent is extended or adjusted under 35 U.S.C. 154(b) by 0 days.

(21) Appl. No.: 09/438,420

(22) Filed: Nov. 12, 1999

(30) Foreign Application Priority Data

Nov. 17, 1998 (BE) ..... 9800830

(51) Int. Cl.[7] ..... F41A 17/00
(52) U.S. Cl. ..... 42/69.03; 42/69.01
(58) Field of Search ..... 42/69.01, 69.03, 42/69.02, 70.01

(56) References Cited

U.S. PATENT DOCUMENTS

| | | | | |
|---|---|---|---|---|
| 1,648,831 | | 11/1927 | Strickler . | |
| 2,365,036 | | 12/1944 | Young . | |
| 3,710,495 | * | 1/1973 | Ziegler et al. | 42/69.03 |
| 3,797,154 | * | 3/1974 | Seecamp | 42/69.03 |
| 4,056,038 | * | 11/1977 | Rath | 89/128 |
| 5,417,001 | * | 5/1995 | Rousseau | 42/70.08 |
| 5,718,074 | * | 2/1998 | Keeney | 42/69.03 |

FOREIGN PATENT DOCUMENTS

| | | | | |
|---|---|---|---|---|
| 1 578 423 | | 4/1971 | (DE) . | |
| 232645 | | 9/1944 | (SE) . | |
| 309376 | * | 3/1969 | (SE) | 42/69.03 |

* cited by examiner

*Primary Examiner*—Peter M. Poon
*Assistant Examiner*—Son T. Nguyen
(74) *Attorney, Agent, or Firm*—Bacon & Thomas PLLC

(57) ABSTRACT

A firing mechanism for fire arms comprising a casing (1) and a trigger guard (1'), a barrel (3), a mobile bolt (5) in the casing (1), comprises a hammer (7) controlling a striker (10), a spring (9) pushing the hammer (7) in its tumbled position, a tumbler (11), a trigger (14) controlling the tumbler (11) by means of a separator (15), a bolt stop (19) which stops the backward movement of the bolt (5) in a locked position and makes the bolt (5) assume another position, a control lever (20) which co-operates with the bolt stop (19) which is also mounted in a revolving manner in the trigger guard (1'). The firing mechanism contains a release lever (27) mounted in a revolving manner in the trigger guard (1') and protruding outside the casing (1), whereby, in a first position, this release lever (27) engages the control lever (20) in the position which the latter assumes when the bolt stop (19) is in the locked position, whereby this release lever (27) makes the control lever (20) revolve as it revolves from said first position into a second position, what is called the release position, such that the bolt stop (19) revolves out of its locking position.

5 Claims, 4 Drawing Sheets

FIRING MECHANISM FOR FIRE ARMS

BACKGROUND OF THE INVENTION

1. Field of the invention

The present invention concerns a firing mechanism for fire arms, comprising a casing and a trigger guard, a barrel and a mobile bolt in the casing, whereby the firing mechanism comprises a hammer controlling the striker and which is mounted in a revolving manner in the casing or in the trigger guard between a 'cocked' and a 'tumbled' position, a spring pushing the hammer in its tumbled position and a revolving tumbler which can retain said hammer in its cocked position, a trigger controlling the tumbler by means of a separator, a bolt stop mounted in a revolving manner in the casing or the trigger guard, whereby said stop stops the backward movement of the bolt in a locked position and makes the bolt go into another position, a control lever which co-operates with said bolt stop which is also mounted in a revolving manner in the casing or in the trigger guard, whereby said control lever can disengage the separator from the tumbler retaining the hammer, such that the separator can no longer control the tumbler.

2. Discussion of the Related Art

Repetition rifles containing a barrel and a mobile bolt or slide, for example with a rotating lock, and which contain firing mechanism of the above-mentioned type are known.

Such a rifle is loaded by moving the bolt from the back to the front, and its repetitive operation is also ensured by moving the mobile bolt from the back to the front and then inversely, whereby said bolt is operated by a loading lever.

When the fire arm is loaded with a cartridge in the fire chamber and the safety device is in the 'firing' position, a pressure on the trigger acts on the tumbler by means of the separator, and the hammer is released, thus launching the striker towards the detonator of the chambered cartridge.

When the hammer is pulled down, it acts on the bolt stop which is released from the stop zone of the mobile bolt, so that the bolt can pass. The projectile having left the barrel, the action of the shooter on the loading lever in order to make the bolt and other mobile parts move back, results in the rotation of the breech bolt and subsequently in the extraction and ejection of the case.

The hammer is pulled down again and recocked by the bolt during its recoil movement.

When the mobile bolt is moved forward again by means of the loading lever, a new cartridge which has come out of the magazine is situated on the feeder, and the base of this cartridge will interact with the breech bolt and will be progressively driven towards the fire chamber by this breech bolt.

When the breech bolt is entirely engaged, the mobile bolt is situated in front of the bolt stop which has reassumed its locking position. The fire arm is ready to fire the next shot.

It is possible that, after having loaded the fire arm, the shooter wishes to unload it. In this case, he has to remove the cartridge situated in the fire chamber, which can only be done by revolving the bolt stop out of its locking position, which simultaneously puts the separator in a position in which the tumbler can no longer be controlled.

Certain known firing mechanisms to this end have a small grip fixed to the control lever co-operating with the stop, whereby this grip protrudes outside the casing, next to the trigger guard.

However, this grip is not easy to handle, as one has to hold the fire arm and simultaneously pull the bolt backwards.

SUMMARY OF THE INVENTION

The present invention aims to remedy this disadvantage and to provide a firing device which makes it possible to remove a chambered cartridge in an easy, safe manner while the device is loaded.

This aim is reached according to the invention in that the firing device contains a release lever mounted in a revolving manner in the casing or in the trigger guard and protruding outside the casing and co-operating with one far end with the control lever, whereby, in a first position, this release lever engages said control lever in the position which the latter assumes when the bolt stop is in the locked position, whereby this release lever makes the control lever revolve as it revolves from said first position into a second position, what is called the release position, such that the bolt stop revolves out of its locking position.

Preferably, the release lever co-operates in such a manner that the two above-mentioned positions are stable positions.

The control lever may to this end be provided with two notches, one for each position of the release lever, whereby this lever penetrates with one end in either of the notches in each position.

The bolt stop can be provided with at least one ramp which, in the position in which it is situated when the release lever is situated in the above-mentioned release position, co-operates with the bolt without locking it, such that the movement of the bolt makes the stop and thus the control lever revolve, thus breaking the contact between said control lever and the release lever and making it possible for said release lever to return into its first position.

In this case, a spring may act on the release lever, pushing the release lever into its first position.

Thus, this release lever automatically returns into its first position as soon as it is no longer withheld by the control lever.

BRIEF DESCRIPTION OF THE DRAWINGS

In order to better explain the characteristics of the invention, an embodiment of a firing device for a fire arm according to the invention is described as an example only without being limitative in any way, with reference to the accompanying drawings, in which.

DESCRIPTION OF THE PREFERRED EMBODIMENT

Figure 1:
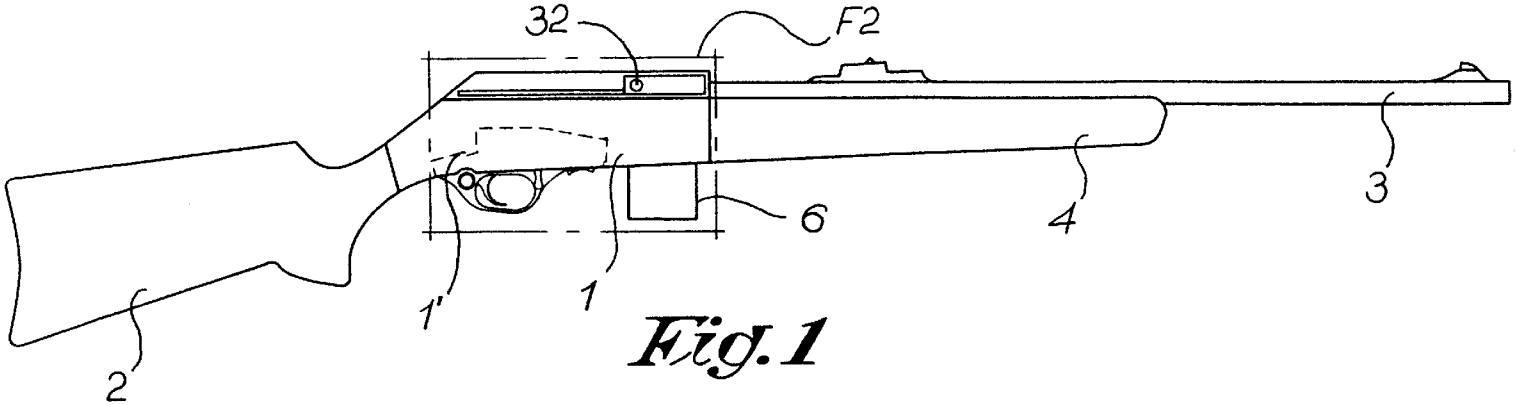
FIG. 1 is a schematic representation of a rifle provided with a firing device according to the invention.
Figure 2:
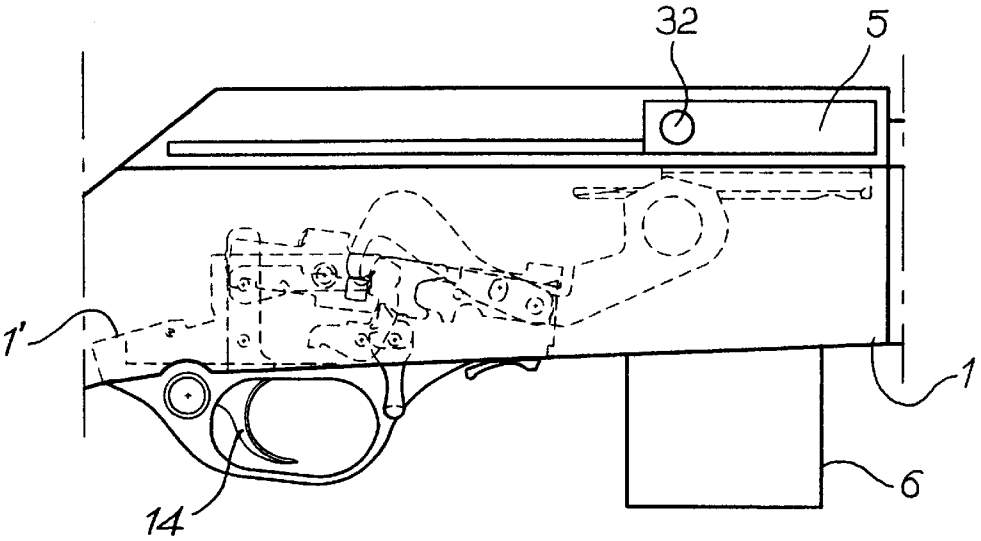
FIG. 2 represents the part of the fire arm indicated by F2 in FIG. 1 to a larger scale.

A rifle, represented schematically in FIGS. 1 and 2, mainly comprises a casing 1, a trigger guard 1' mounted upon it, a butt 2 mounted on one far end of the casing 1, a barrel 3 with the fire chamber, mounted on the other far end of the casing 1 and a handshield 4, a loading mechanism and a firing mechanism.

Figure 3:
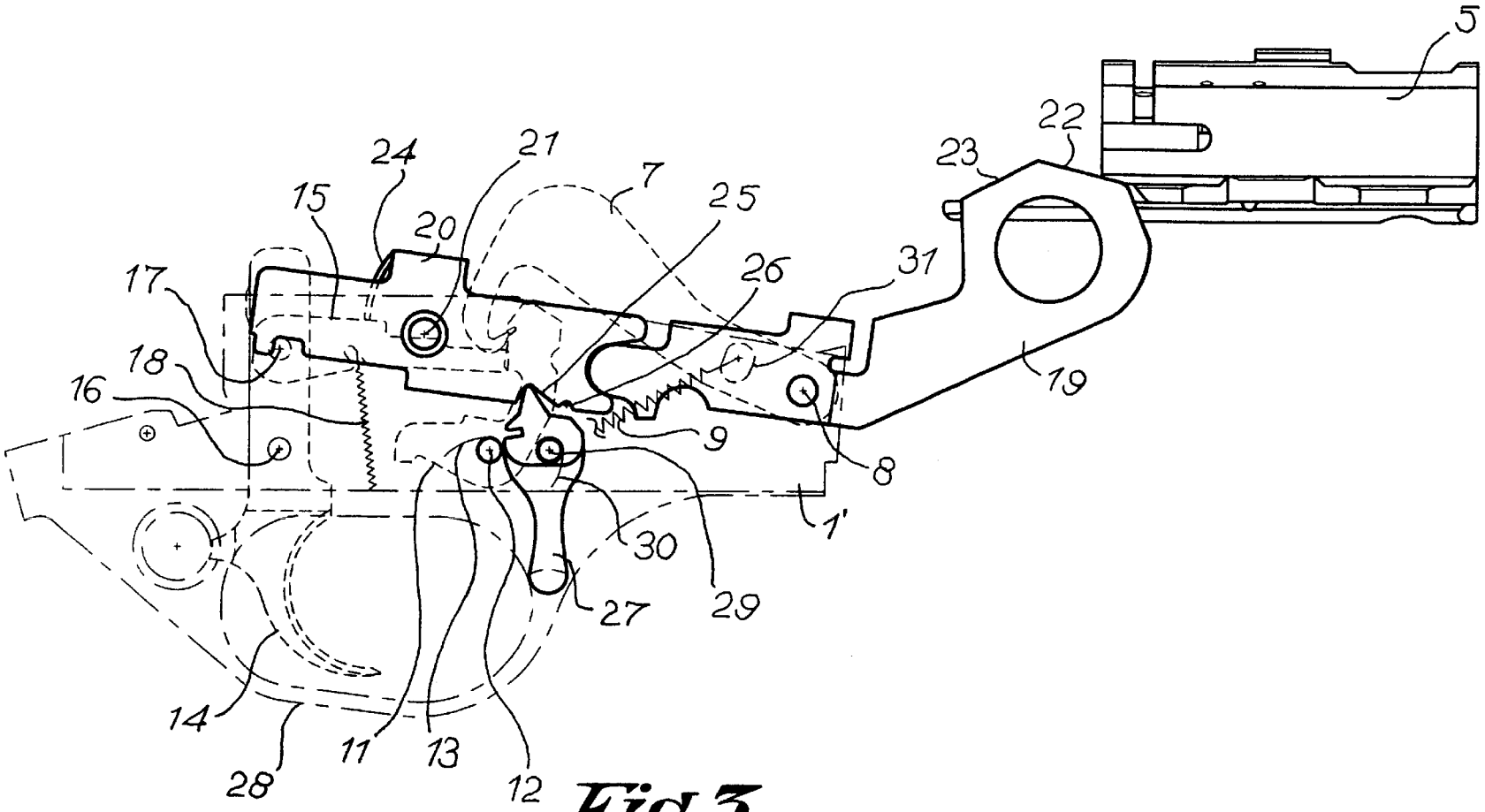
FIG. 3 is a schematic representation of the firing mechanism according to the invention which is part of the fire arm of FIGS. 1 and 2, in the shooting position.
Figure 4:
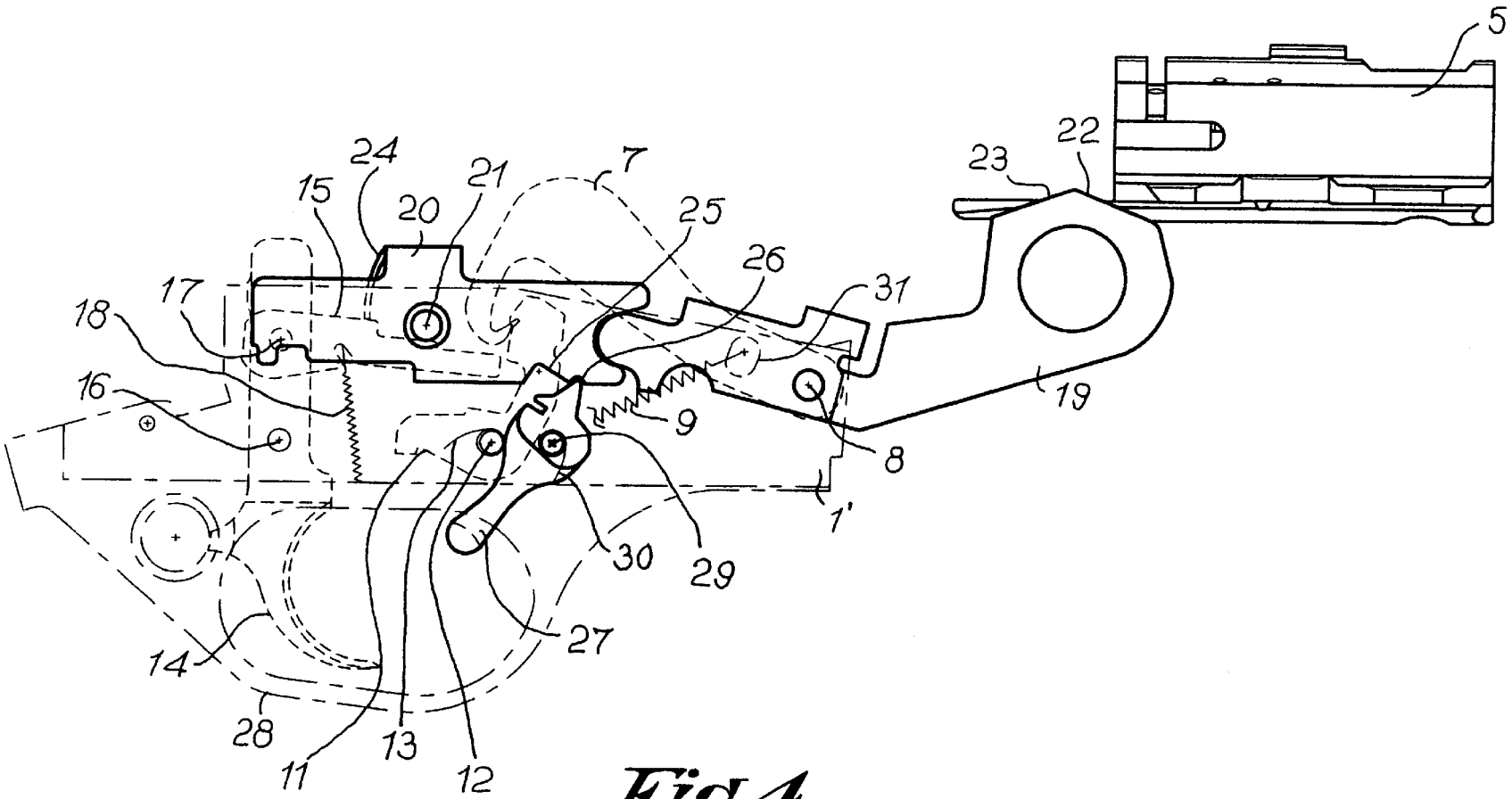
FIG. 4 represents the mechanism of FIG. 3, but in another position, i.e. the release position.
Figure 5:
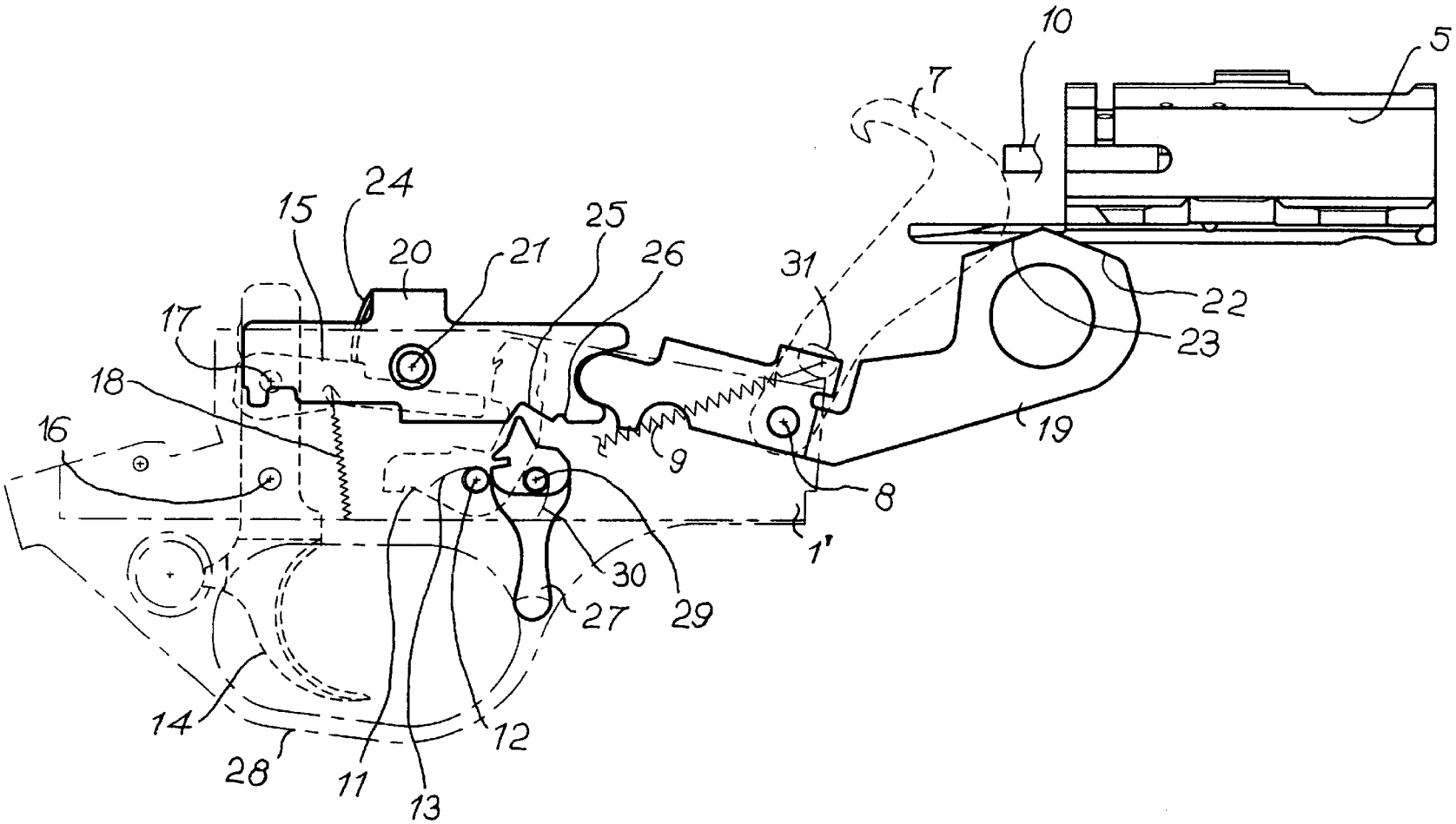
FIG. 5 represents the device of FIGS. 3 and 4, but in yet another position, i.e. the position after the shooting.

The loading mechanism comprises a bolt 5 which is mounted in a mobile manner on the casing 1 and controls a rotating breech bolt which can seal the fire chamber, a chamber in which can be introduced a cartridge out of a loader 6. The firing mechanism which is represented in greater detail in FIGS. 3 to 5 comprises a hammer 7 mounted in a revolving manner in the trigger guard 1', represented by means of various lines, around a transversal shaft 8 between what is called a 'cocked' position, as represented in FIGS. 3 and 4, and what is called a 'tumbled' position, represented in FIG. 5, a spring 9 of which only one part is represented in FIGS. 3 to 5, pushing the hammer 7 in its tumbled position, whereby this hammer 7 controls the striker 10 which is only represented in FIG. 5.

A tumbler 11 is also mounted in a revolving manner around a transversal shaft 12 and, in a position in which it is pushed by a spring 13, it can retain the hammer 7 in the cocked position.

A trigger 14 controlling the tumbler 11 by means of a lever or separator 15 can revolve around a transversal shaft 16 in the trigger guard 1'. The separator 15 is fixed to the trigger 14 by means of a transversal shaft 17 and is pushed into the position as represented in FIGS. 3 to 5 by means of a spring 18.

This firing mechanism further comprises a bolt stop 19 mounted in a revolving manner in the trigger guard 1' around the same transversal shaft 8 as the hammer 7.

This bolt stop 19, in its locking position as represented in FIG. 3, stops the backward movement of the bolt 5 and makes this bolt 5 assume another position, as represented in FIGS. 4 and 5. This bolt stop 19 is forked in its rear far end by the front far end of a control lever 20 which is also mounted in a revolving manner around a transversal shaft 21 on the casing 1 or the trigger guard 1'.

The top of the front far end of the bolt stop 19 is provided with a system of ramps 22 and 23 descending towards the front and the back respectively.

In the back, in relation to its shaft 21, the control lever 20 is provided with a central excrescence 24 which can rest on the separator 15, and with the help of which this control lever 20 can disengage the separator 15 from the tumbler 11, such that the separator 15 can no longer control the tumbler 11, as represented in FIG. 4.

Near its front far end, the control lever 20 has two notches 25 and 26 in its lower edge, whereby the notch 25 which is situated on the side of the shaft 21 is deeper in relation to the other one.

A release lever 27, situated to the right of the guard 28 of the trigger guard 1', can penetrate into either of the notches 25 or 26 with its pointed top end. This release lever 27 revolves around a transversal shaft 29 mounted in the trigger guard 1' between a first vertical position as represented in FIGS. 3 and 5 and an inclined position as represented in FIG. 4.

A spring 30 which rests on the trigger guard 1' pushes the release lever 27 into its first vertical position. The dimensions of this release lever 27 and the notches 25 and 26 are such that the bolt stop 19 can only be situated in its locking position when the pointed end of the release lever 27 is situated in the notch 25, whereas, when this far end is situated in the notch 26, the bolt stop 19 is situated in an intermediary position, i.e. without locking the bolt 5, but nevertheless with one ramp 22 still in the trajectory of the bolt 5.

Near its shaft 8, the hammer 7 has a protrusion 31, to which is fixed the spring 9. This protrusion 31 strikes against the bolt stop 19 when the hammer 7 goes from the cocked position into the tumbled position. For clarity's sake, the bolt stop 19, the control lever 20 and the release lever 27 are represented by means of full lines in FIGS. 3 to 5, whereas the other elements of the firing mechanism are represented by means of broken lines. The above-described firing mechanism works as follows: In the 'ready to shoot' position, represented in FIG. 3, the hammer 7 is in the cocked position and thus hooked with its far end in the nozzle of the tumbler 11, and the separator 15 makes contact with the tumbler 11.

The release lever 27 penetrates in the notch 25 with one far end, which implies that the bolt stop 19 is in the locked position and locks the bolt 5 in its front position. The breech bolt seals the fire chamber in which is situated a cartridge.

In order to be able to extract this cartridge from the fire chamber without shooting, one only has to make the release lever 27 revolve into its inclined release position, i.e. with its far end in the notch 26, as represented in FIG. 4.

The above-mentioned revolving of the release lever 27 into its release position makes the control lever 20 and consequently also the bolt stop 19 revolve into the above-mentioned intermediary position.

While it revolves, the control lever 20 rests with excrescence 24 on the separator 15 which is thus put in a position where it is disengaged from the tumbler 11 and can no longer control the latter.

Shooting is no longer possible and, as the bolt stop 19 no longer locks the bolt 5, the latter can be pulled safely backwards by means of the loading lever 32, whereby this recoil results in the non-fired cartridge being unlocked and extracted.

As the release lever 27 fits in the notch 26, it is situated in a stable position and must not be retained manually in this position.

As the notch 26 is not very deep, the slightest revolving of the control lever 20 will have for a result that the release lever 27 goes back into its vertical position due to the action of the spring 30.

During said backward movement of the bolt 5, the latter makes the bolt stop 19, which is in the intermediary position, revolve slightly, making the control lever 20 revolve as mentioned above, such that, after the bolt 5 has moved forward again, the latter is locked again and the firing mechanism is again in the position as represented in FIG. 3.

In FIG. 5, said mechanism is represented after a shot has been fired, and thus with the hammer 7 being pulled down.

Due to the action of the trigger 14 and with the help of the separator 15 and the tumbler 11, the hammer 7 has been released and has pushed the striker 10 back. During this movement of the hammer 7, the protrusion 31 has knocked against the bolt stop 19 and has made the latter revolve, such that the far end with the ramps 22 and 23 is in its lowest position. As a result thereof, the control lever 20 has disengaged the separator 15 from the tumbler 11 by means of the excrescence 24.

The release lever 27 is situated in the vertical position, but without making contact with the control lever 20.

The hammer 7 is pulled down again in the cocked position as a result of the recoil of the bolt 5, whereby, as the bolt 5moves forward again, it introduces a cartridge in the fire chamber in the conventional manner and locks this chamber.

Although, in the above-described example, the hammer 7, the bolt stop 19, the control lever 20 and the release lever 27 are mounted in the trigger guard 1', it is clear that, according to another embodiment, one or several of these elements can be mounted in the casing 1.

Moreover, according to a particular embodiment, the trigger guard 1' can form a whole with the casing 1.

The invention is by no means limited to the above-described embodiments represented in the accompanying drawings; on the contrary, the above-described device can be made in all sorts of variants while still remaining within the scope of the invention.

What is claimed is:

1. A firing mechanism for fire arms comprising a casing and a trigger guard, a barrel and a mobile bolt in the casing, said firing mechanism comprising a hammer controlling the striker and which is mounted in a revolving manner in the casing or in the trigger guard between a'cocked' and a 'tumbled' position, a spring pushing the hammer in its tumbled position and a revolving tumbler which can retain said hammer in its cocked position, a trigger controlling the tumbler by means of a separator, a bolt stop mounted in a revolving manner in the casing or the trigger guard, whereby said bolt stop stops the backward movement of the bolt in a locked position and makes the bolt assume another position, a control lever which co-operates with said bolt stop which is also mounted in a revolving manner in the casing or in the trigger guard, whereby said control lever can disengage the separator from the tumbler retaining the hammer, such that the separator can no longer control the tumbler, in which said firing mechanism contains a release lever mounted in a revolving manner in the casing or in the trigger guard and protruding outside the casing and cooperating with one far end with the control lever, whereby, in a first position, this release lever engages said control lever in the position which the latter assumes when the bolt stop is in the locked position, and whereby this release lever makes the control lever revolve as it revolves from said first position into a second position, what is called the release position, such that the bolt stop revolves out of its locking position.

2. The firing mechanism of claim 1, in which the release lever co-operates such that the two above-mentioned positions are stable positions.

3. The firing mechanism of claim 2, in which the control lever is provided with two notches, one for each position of the release lever, whereby this lever penetrates with one far end in either of the notches in each position.

4. The firing mechanism of claim 1, in which the bolt stop is provided with at least one ramp which, in the position in which it is situated when the release lever is situated in the above-mentioned release position, co-operates with the bolt without locking it, such that the movement of the bolt makes the stop and thus the control lever revolve, thus breaking the contact between said control lever and the release lever and making it possible for said release lever to return into its first position.

5. The firing mechanism of claim 4, further comprising a spring which acts on the release lever, pushing the release lever into its first position.

* * * * *